US009348288B2

(12) United States Patent
Kaneko et al.

(10) Patent No.: US 9,348,288 B2
(45) Date of Patent: May 24, 2016

(54) IMAGE FORMING APPARATUS FORMING A PLURALITY OF DISPLACED TEST LATENT IMAGE PARTS

(71) Applicants: Satoshi Kaneko, Kanagawa (JP); Shinji Kato, Kanagawa (JP); Shuji Hirai, Tokyo (JP); Hideo Muroi, Kanagawa (JP); Terumichi Ochi, Kanagawa (JP)

(72) Inventors: Satoshi Kaneko, Kanagawa (JP); Shinji Kato, Kanagawa (JP); Shuji Hirai, Tokyo (JP); Hideo Muroi, Kanagawa (JP); Terumichi Ochi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/619,387

(22) Filed: Feb. 11, 2015

(65) Prior Publication Data

US 2015/0261162 A1 Sep. 17, 2015

(30) Foreign Application Priority Data

Mar. 14, 2014 (JP) ..... 2014-051859

(51) Int. Cl.

| | |
|---|---|
| ***G03G 15/00*** | (2006.01) |
| ***G03G 15/043*** | (2006.01) |
| ***G03G 15/06*** | (2006.01) |

(52) U.S. Cl.

CPC ..... *G03G 15/5041* (2013.01); *G03G 15/043* (2013.01); *G03G 15/065* (2013.01)

(58) Field of Classification Search

CPC ..... G03G 15/5041; G03G 15/5058; G03G 15/043; G03G 15/065

See application file for complete search history.

(56) References Cited

U.S. PATENT DOCUMENTS

| | | | | |
|---|---|---|---|---|
| 2003/0012578 | A1* | 1/2003 | Ishii | G03G 15/5041 399/49 |
| 2009/0016750 | A1* | 1/2009 | Kobayashi | G03G 15/065 399/49 |
| 2011/0052231 | A1* | 3/2011 | Kitao | G03G 15/0194 399/49 |
| 2011/0103815 | A1* | 5/2011 | Hanashi | G03G 15/0131 399/49 |

FOREIGN PATENT DOCUMENTS

| | | |
|---|---|---|
| JP | 6-130767 | 5/1994 |
| JP | 06-130767 | * 5/1994 |
| JP | 7-271139 | 10/1995 |
| JP | 8-044168 | 2/1996 |
| JP | 2005-241925 | 9/2005 |
| JP | 2005-258386 | 9/2005 |
| JP | 2006-064955 | 3/2006 |
| JP | 2007-102126 | 4/2007 |
| JP | 2008-304646 | 12/2008 |
| JP | 2009-015211 | 1/2009 |

* cited by examiner

*Primary Examiner* — Sandra Brase

(74) *Attorney, Agent, or Firm* — Oblon, McClelland, Maier & Neustadt, L.L.P.

(57) ABSTRACT

An image forming apparatus includes a latent image bearer, a toner image forming unit, and a transfer device. The toner image forming unit includes a charger, a latent image forming device, and a developing device, and is configured to form a test latent image pattern on a surface of the latent image bearer, and to develop the test latent image pattern into a test toner pattern. The test latent image pattern includes a plurality of test latent image parts partly offset from one another in a main scanning direction. The image forming apparatus also includes a developing current detector and a processor to detect uneven image density in the main scanning direction using the test latent image pattern, based on the developing current detected by the developing current detector, to adjust the uneven image density in the main scanning direction.

13 Claims, 10 Drawing Sheets

IMAGE FORMING APPARATUS FORMING A PLURALITY OF DISPLACED TEST LATENT IMAGE PARTS

CROSS-REFERENCE TO RELATED APPLICATION

This patent application is based on and claims priority pursuant to 35 U.S.C. §119(a) to Japanese Patent Application No. 2014-051859, filed on Mar. 14, 2014, in the Japan Patent Office, the entire disclosure of which is hereby incorporated by reference herein.

BACKGROUND

1. Technical Field

Embodiments of the present invention generally relate to an image forming apparatus for forming a toner image on a recording medium.

2. Background Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium directly, or indirectly via an intermediate transfer belt. Finally, a fixing device applies heat and pressure to the recording medium carrying the toner image to fix the toner image onto the recording medium.

SUMMARY

In one embodiment of the present invention, an improved image forming apparatus is described that includes a rotatable latent image bearer, a toner image forming unit, and a transfer device. The toner image forming unit includes a charger to charge a surface of the latent image bearer, a latent image forming device to form a latent image on the surface of the latent image bearer according to image data, and a developing device that includes a developer bearer to apply developing bias between the latent image bearer and the developer bearer to move toner from the developer bearer to the latent image to form a toner image on the surface of the latent image bearer. The transfer device transfers the toner image onto a recording medium. The toner image forming unit is configured to form a test latent image pattern on the surface of the latent image bearer, and to develop the test latent image pattern into a test toner pattern. The test latent image pattern includes a plurality of test latent image parts partly offset from one another in a main scanning direction that is perpendicular to a direction in which the latent image bearer rotates. The image forming apparatus also includes a developing current detector to detect a developing current between the developer bearer and the latent image bearer during development of the test latent image pattern, and a processor to detect uneven image density in the main scanning direction using the test latent image pattern, based on the developing current detected by the developing current detector, to adjust the uneven image density in the main scanning direction.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
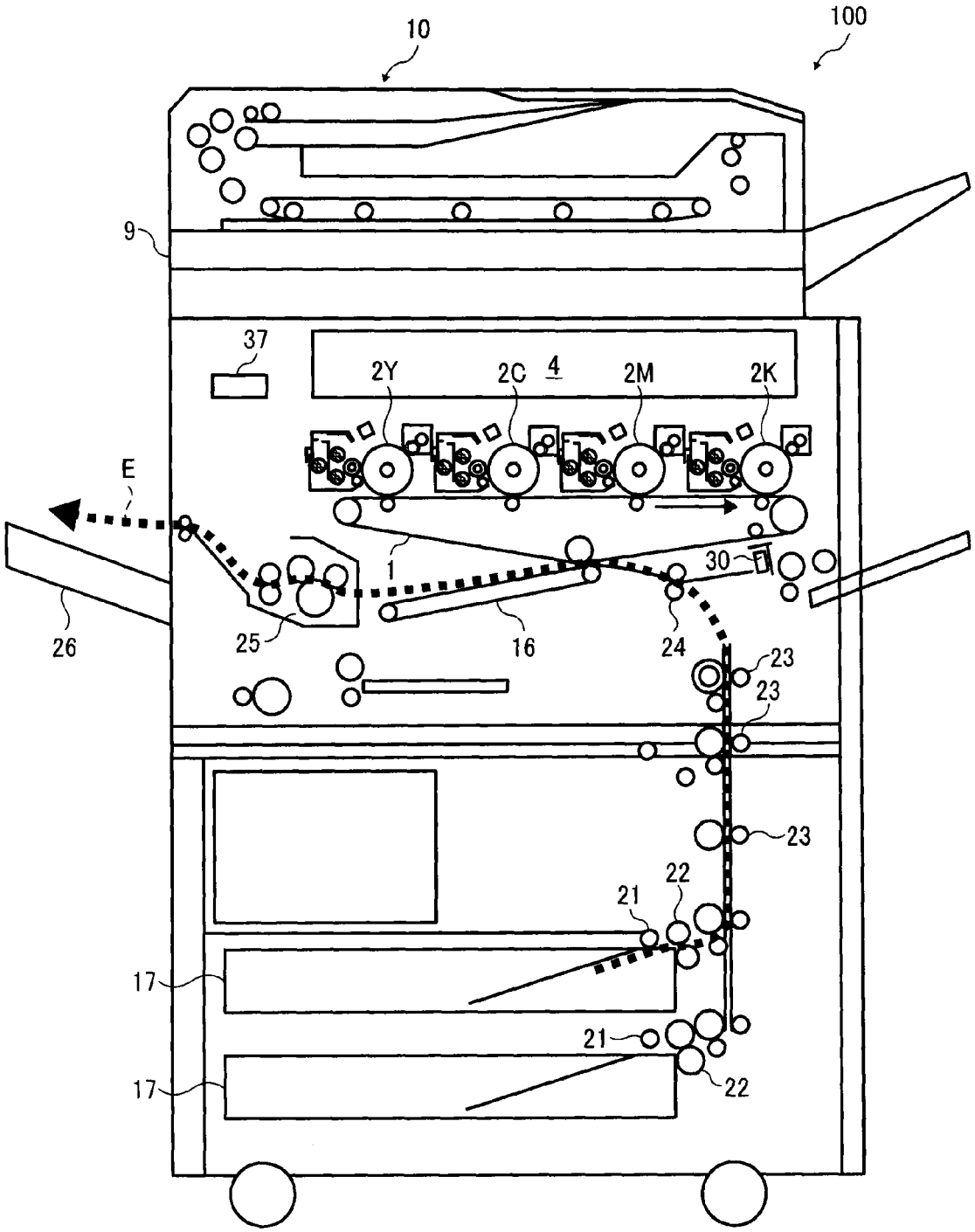
FIG. 1 is a schematic view of an image forming apparatus according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and not all of the components or elements described in the embodiments of the present invention are indispensable.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

It is to be noted that, in the following description, suffixes Y, M, C, and K denote colors yellow, magenta, cyan, and black, respectively. To simplify the description, these suffixes are omitted unless necessary.

Referring now to the drawings, wherein like reference numerals designate identical or corresponding parts throughout the several views, embodiments of the present invention are described below.

Figure 2:
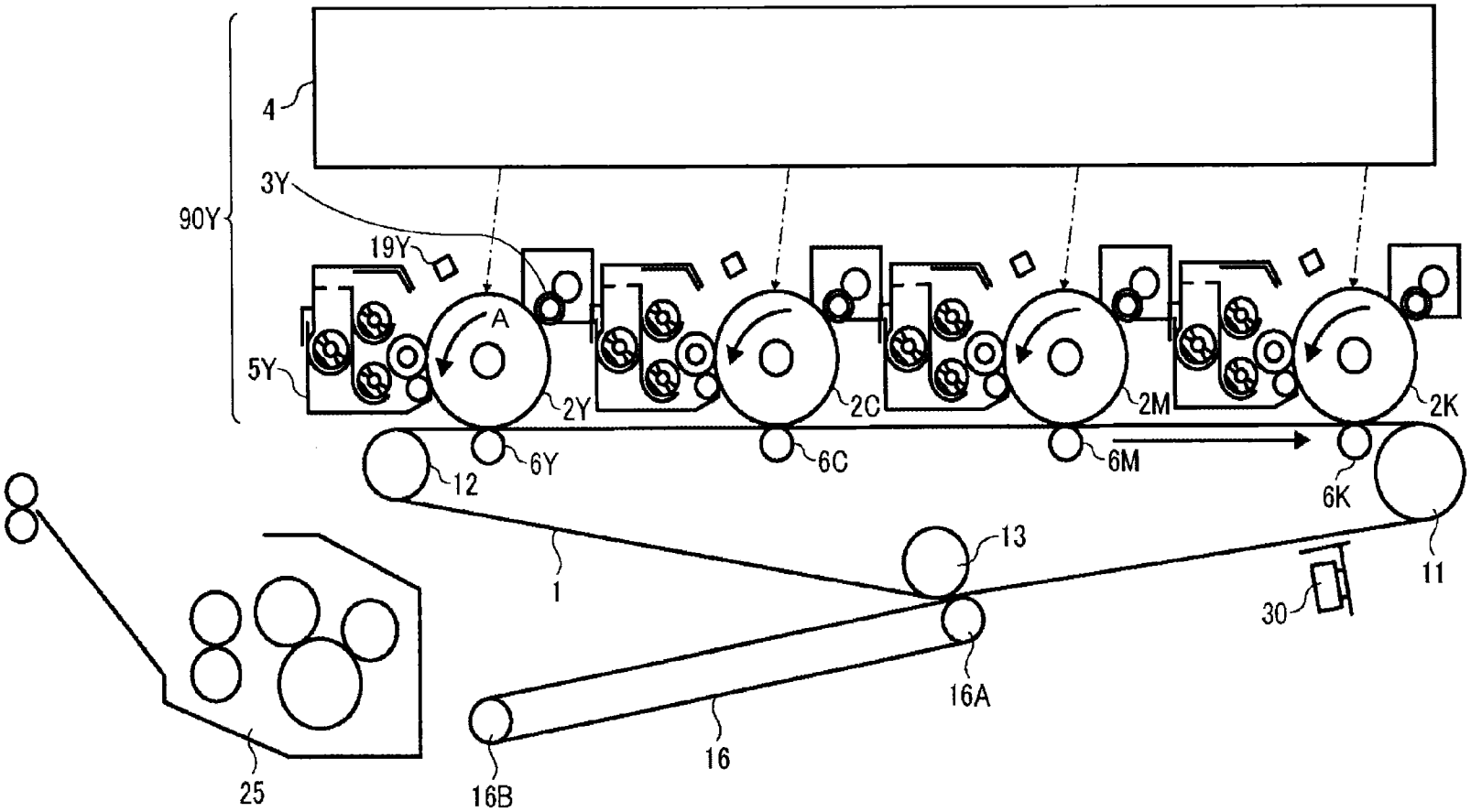
FIG. 2 is a partial enlarged schematic view of the image forming apparatus.

Initially with reference to FIGS. 1 and 2, a description is given of a configuration of an image forming apparatus 100 according to an embodiment of the present invention.

FIG. 1 is a schematic view of the image forming apparatus 100. FIG. 2 is a partial enlarged schematic view of the image forming apparatus 100.

In the present embodiment, the image forming apparatus 100 is a full-color machine that incorporates four photoconductors 2Y, 2C, 2M, and 2K arranged side by side, and is configured to transfer a toner image onto a recording medium via an intermediate transfer belt 1. Alternatively, in some embodiments, the image forming apparatus 100 is, e.g., a full-color machine that incorporates the four photoconductors 2Y, 2C, 2M, and 2K arranged side by side and is configured to transfer a toner image onto a recording medium directly, a full-color machine that incorporates one photoconductor 2 and is configured to transfer a toner image onto a recording medium via the intermediate transfer belt 1, or a monochrome machine that incorporates one photoconductor 2 and is configured to transfer a toner image onto a recording medium directly.

As illustrated in FIG. 1, the image forming apparatus 100 includes the intermediate transfer belt 1 serving as an intermediate transfer body and the four photoconductors 2Y, 2C, 2M, and 2K serving as latent image bearers arranged side by side along a tensioned surface of the intermediate transfer belt 1.

As illustrated in FIG. 2, the intermediate transfer belt 1 is rotatably supported by support rollers 11, 12, and 13. The intermediate transfer belt 1 is made of low-stretchable resin material, such as polyimide, in which carbon powder is dispersed to adjust electrical resistance. Inside a loop formed by the intermediate transfer belt 1, four primary transfer rollers 6Y, 6M, 6C, and 6K are disposed facing the photoconductors 2Y, 2C, 2M, and 2K, respectively. The support roller 13 faces a secondary transfer belt 16 serving as a transfer body. The secondary transfer belt 16 is rotatably supported by support rollers 16A and 16B.

Each of the four photoconductors 2Y, 2C, 2M, and 2K is surrounded by various devices. For example, the photoconductor 2Y is surrounded by, e.g., a charging roller 3Y serving as a charger, a surface potential sensor 19Y serving as a potential detector to detect surface potential of the photoconductor 2Y, and a developing device 5Y, in that order in a rotational direction indicated by arrow A (hereinafter referred to as rotational direction A). Above the four photoconductors 2Y, 2C, 2M, and 2K is an optical writing unit 4 serving as a latent image forming unit to irradiate each of the four photoconductors 2Y, 2C, 2M, and 2K with laser beams to write an electrostatic latent image thereon. A yellow toner image forming unit 90Y that includes, e.g., the charging roller 3Y, the optical writing unit 4, and the developing device 5Y forms a yellow toner image on the photoconductor 2Y. Toner image forming units 90 for the other colors have the same configuration as the yellow toner image forming unit 90Y, and form their respective color toner images on the respective photoconductors 2.

The optical writing unit 4 includes four laser diodes driven by a laser controller. The laser diodes emit the laser beams as writing light according to image data toward the photoconductors 2, the surfaces of which are uniformly charged by the charging roller 3, to form electrostatic latent images on the charged surfaces of the photoconductor 2. According to the present embodiment, the optical writing unit 4 further includes, e.g., a polygon mirror that deflects the laser beam from the laser diode, a reflecting mirror that reflects the laser beam, and an optical lens through which the laser beam passes. Alternatively, in some embodiments, the optical writing unit 4 includes a light emitting diode (LED) array to irradiate the surfaces of the photoconductors 2 with laser beams.

The surface potential sensors 19 detect potential of the electrostatic latent images thus formed on the photoconductors 2 by the optical writing unit 4, that is, the surface potential of the photoconductors 2 before the developing devices 5 develop the electrostatic latent images into visible toner images. The surface potential thus detected is used to determine image forming conditions such as charging bias of the charging rollers 3 and exposure power or laser power of the optical writing unit 4, thereby maintaining stable image density.

Referring back to FIG. 1, the image forming apparatus 100 includes, e.g., a scanner 9 and an automatic document feeder (ADF) 10 above the optical writing unit 4. In a lower portion of the image forming apparatus 100, trays 17 are provided that accommodate recording media. The trays 17 also serve as sheet feeders. A pickup roller 21, a pair of feed rollers 22, pairs of conveyance rollers 23, and a pair of registration rollers 24 are provided along a recording medium conveyance passage E indicated by the broken line starting from one of the trays 17 as an example. The pickup roller 21 picks up a recording medium from the tray 17 to feed the recording medium to the pair of feed rollers 22. The pair of feed rollers 22 feeds the recording medium to the pairs of conveyance rollers 23, which convey the recording medium to the pair of registration rollers 24. The pair of registration rollers 24 feeds the recording medium at a predetermined time toward a secondary transfer area called a secondary transfer nip formed between the intermediate transfer belt 1 and the secondary transfer belt 16.

A fixing device 25 is disposed on the recording medium conveyance passage E downstream from the secondary transfer nip in a direction in which the recording medium is conveyed. An ejection tray 26 is disposed downstream from the fixing device 25 in the direction in which the recording medium is conveyed.

The image forming apparatus 100 also includes an image density sensor 30 and a controller 37 implemented as a central processing unit (CPU) provided with, e.g., a nonvolatile memory and a volatile memory. The image density sensor 30 is an optical sensor that detects an amount of toner attached per unit area, that is, image density of a toner pattern formed on an outer circumferential surface of the intermediate transfer belt 1.

Figure 3:
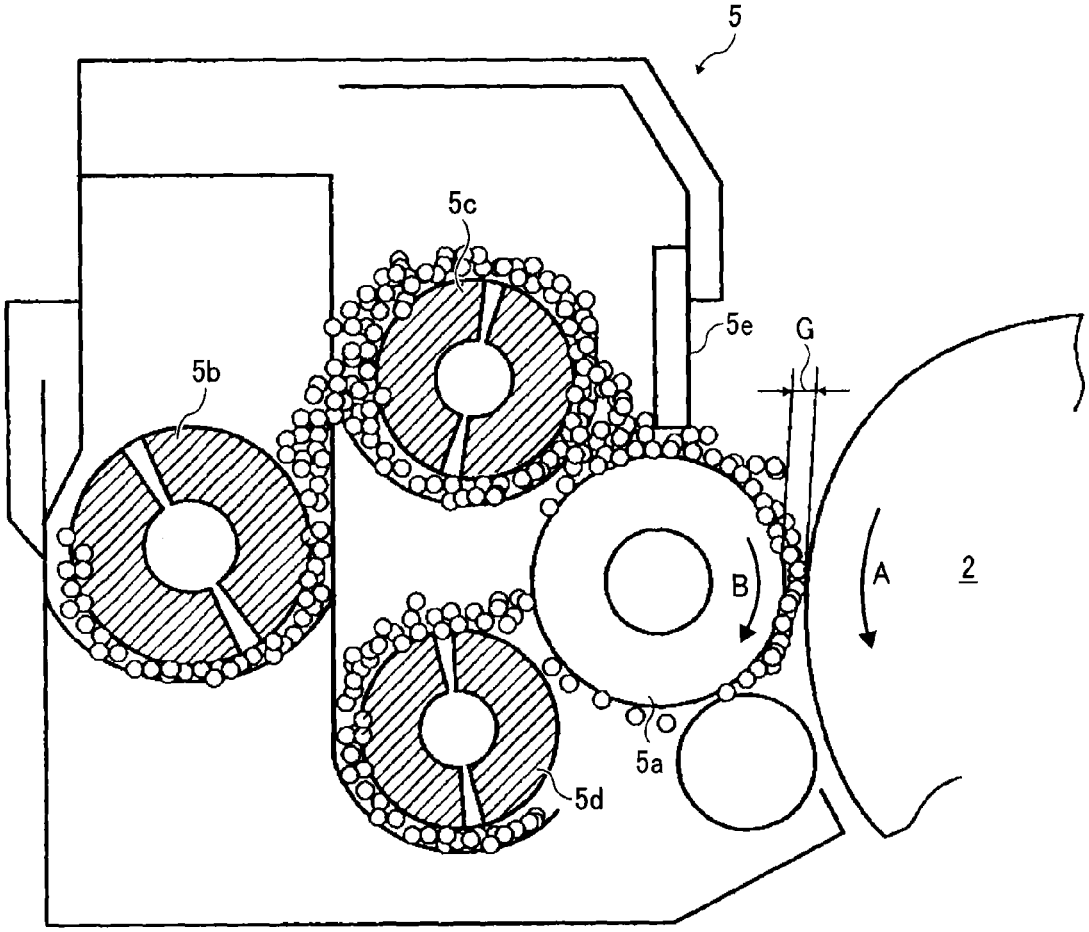
FIG. 3 is a schematic view of a developing device incorporated in the image forming apparatus.

Referring now to FIG. 3, a detailed description is given of the developing devices 5. FIG. 3 is a schematic view of one of the developing devices 5. The developing devices 5 are identical in configuration. Therefore, in the following description and FIG. 3 the suffixes Y, M, C, and K are omitted.

As illustrated in FIG. 3, the developing device 5 includes a developing roller 5*a* serving as a developer bearer close to the surface of the photoconductor 2, with a developing gap G formed between the developing roller 5*a* and the surface of the photoconductor 2. The developing roller 5*a* bears two-component developer containing toner and carrier, and attaches the toner to the surface of the photoconductor 2 in a developing area facing the photoconductor 2. Thus, the developing device 5 develops the electrostatic latent image formed on the photoconductor 2 into a visible toner image.

In a developing container of the developing device 5, a stirring screw 5*b* serving as a developer stirrer, a supply screw 5*c*, and a collecting screw 5*d* are disposed in parallel with the developing roller 5*a*. The stirring screw 5*b* conveys the developer to a front end of the stirring screw 5*b* in FIG. 3 while stirring the developer, and further to the supply screw 5*c* through an opening. The supply screw 5*c* conveys the developer along the developing roller 5*a* while stirring the developer to supply the developer onto a surface of the developing roller 5*a*. A magnetic field generator disposed inside the developing roller 5*a* generates a magnetic field so that the developing roller 5*a* bears the developer thus supplied on the surface thereof and conveys the developer in a direction indicated by arrow B in which the developing roller 5*a* rotates.

Figure 4:
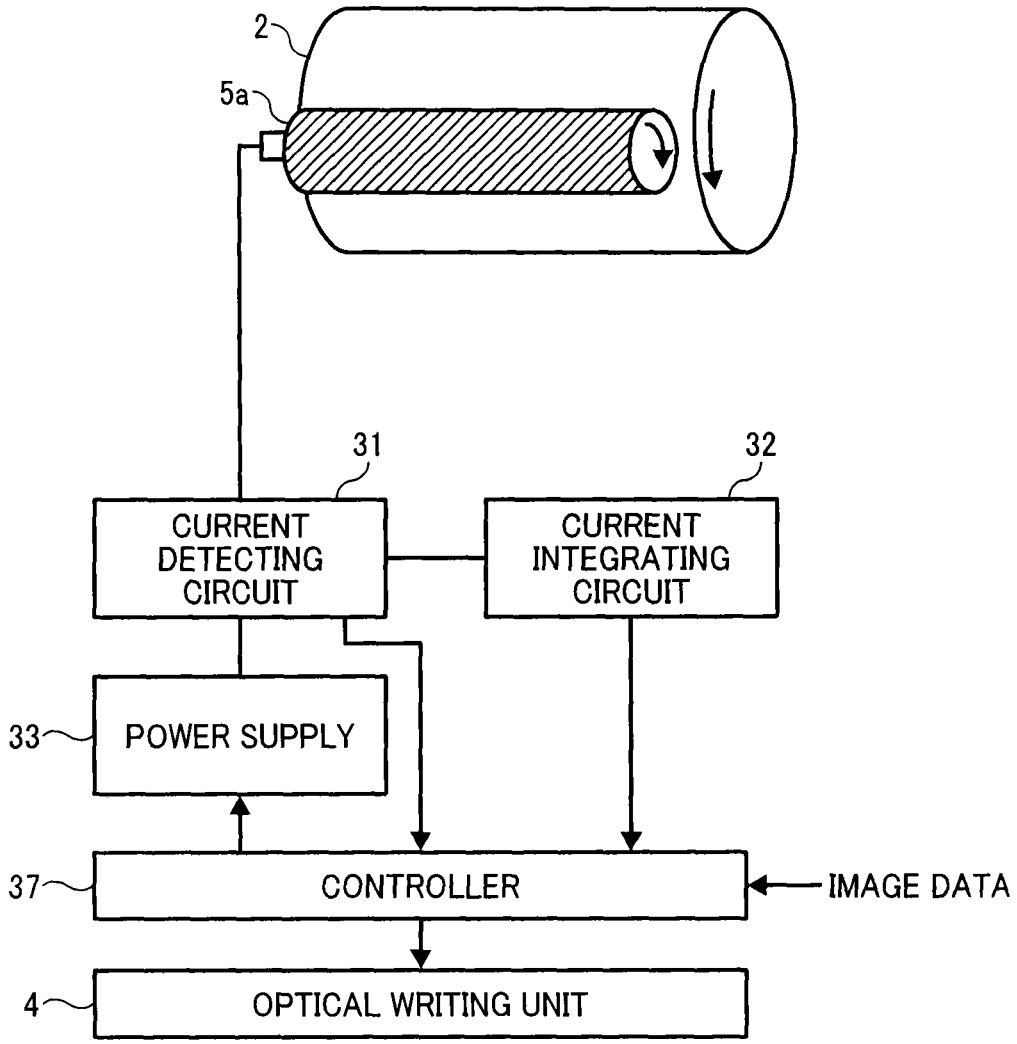
FIG. 4 is a block diagram of a main control system of the image forming apparatus.

The developing device 5 also includes a doctor blade 5*e* serving as a developer regulator. After the doctor blade 5*e* regulates the height of the layer of developer borne on the surface of the developing roller 5*a*, the developer is conveyed by the rotation of the developing roller 5*a* to the developing area facing the surface of the photoconductor 2 rotating in the rotational direction A. Developing bias is applied to the developing area by developing voltage applied to the developing roller 5*a* from a power supply 33, which is illustrated in FIG. 4. The developing bias forms a developing electrical field between the surface of the developing roller 5*a* and the electrostatic latent image formed on the photoconductor 2. The developing electrical field causes toner to move to the electrostatic latent image, rendering the electrostatic latent image visible as a toner image. Thus, a developing process is performed. Note that the developing process consumes the toner and thus reduces toner density in the developer that is contained in the developing container of the developing device 5. In response to such reduction of the toner density, a toner supplier supplies toner to the developing container through an opening above the stirring screw 5*b*.

In the present embodiment, the developing roller 5*a* and the photoconductor 2 rotate in different directions, with the developing roller 5*a* rotating clockwise and the photoconductor 2 rotating counterclockwise. Alternatively, in some embodiments, the developing roller 5*a* and the photoconductor 2 rotate in the same direction, or a plurality of developing rollers may be used. Additionally, in the present embodiment, two-component developer is used. Alternatively, in some embodiments, one-component developer that does not contain carrier is used.

To provide a fuller understanding of embodiments of the present invention, a description is now given of an image forming operation with continued reference to FIG. 1.

In response to an input of an order to start a print job, the rollers around the photoconductors 2, the intermediate transfer belt 1, and the recording medium conveyance passage E start rotating at their predetermined times while a recording medium is fed from one of the trays 17. In the meantime, the charging rollers 3 charge the surfaces of the photoconductors 2 to uniform potential and the optical writing unit 4 irradiates or exposes the charged surfaces of the photoconductors 2 with laser beams according to image data of the respective colors to form electrostatic latent images (i.e., potential patterns after exposure) on the surfaces of the photoconductors 2. The developing rollers 5*a* of the developing devices 5 supply toner onto the surfaces of the photoconductors 2 bearing the electrostatic latent images, rendering the electrostatic latent images visible as toner images.

In the present embodiment, yellow, magenta, cyan, and black toner images are formed on the photoconductors 2Y, 2M, 2C, and 2K, respectively. The toner images thus formed on the photoconductors 2 are conveyed to primary transfer areas called primary transfer nips in which the photoconductors 2 face the intermediate transfer belt 1. At the primary transfer nips, the toner images are transferred onto the intermediate transfer belt 1 by primary transfer bias and pressing forces applied to the primary transfer rollers 6 facing the respective photoconductors 2 to form a full-color toner image on the intermediate transfer belt 1.

The pair of registration rollers 24 then conveys the recording medium to the secondary transfer nip so that the full-color toner image is transferred from the intermediate transfer belt 1 onto the recording medium at the secondary transfer nip by secondary transfer bias and a pressing force applied to the secondary transfer belt 16. Then, the recording medium bearing the full-color toner image thereon passes through the fixing device 25 that fixes the full-color toner image onto the recording medium under heat and pressure. Finally, the recording medium is discharged onto the ejection tray 26.

The image density sensor 30 detects image density of a predetermined toner pattern that is formed during image quality adjustment control or process control. The readings provided by the image density sensor 30 is used to determine image forming conditions such as charging bias of the charging rollers 3 and exposure power or laser power of the optical writing unit 4, thereby maintaining stable image density.

Referring now to FIG. 4, a description is given of a main control system of the image forming apparatus 100. FIG. 4 is a block diagram of the main control system of the image forming apparatus 100.

In the present embodiment, the image forming apparatus 100 includes a current detecting circuit 31 and a current integrating circuit 32. The current detecting circuit 31 serves as a developing current detector that detects a developing current between the photoconductor 2 and the developing roller 5*a* of the developing device 5. Specifically, the current detecting circuit 31 detects an electric current that is applied by the power supply 33 to the developing roller 5*a* when the electrostatic latent image formed on the photoconductor 2 according to image data is developed into a toner image with toner moving from the developing roller 5*a*. Most of the current applied by the power supply 33 to the developing roller 5*a* moves to the photoconductor 2 in association with the movement of toner in the developing area. Accordingly, the current detected by the current detecting circuit 31 corresponds to a developing current between the photoconductor 2 and the developing roller 5*a* in the developing process.

In the present embodiment, a value of the developing current detected by the current detecting circuit 31 is converted into a value integrated by the current integrating circuit 32 as an electrical charge, which is inputted into the controller 37. Alternatively, in some embodiments, the value of the developing current detected by the current detecting circuit 31 is inputted into the controller 37 directly. Thus, directly or indirectly the controller 37 receives a voltage signal corresponding to the developing current value. The voltage signal is an output signal from the current detecting circuit 31 or the current integrating circuit 32, which may be filtered through a filter circuit having an appropriate cutoff frequency.

Typically, in image forming apparatuses, uneven image density may be caused in a main scanning direction, which is perpendicular to a direction in which a latent image bearer rotates, due to various factors such as deviation of a developing gap in the main scanning direction between a developer bearer and the latent image bearer, fluctuation in the main scanning direction in amount of developer conveyed to the developing gap by the developing bearer, and uneven charging in the main scanning direction.

In the present embodiment, a process of correcting uneven image density in the main scanning direction at a predetermined time, for example, upon execution of the image quality adjustment control or process control, is conducted. The process starts with forming a latent image pattern for detecting uneven image density in the main scanning direction (hereinafter simply referred to as a test latent image pattern) on the photoconductor 2 with the optical writing unit 4. Then, the current detecting circuit 31 detects a developing current generated when the developing device 5 develops the test latent image pattern. According to the developing current detected by the current detecting circuit 31, the controller 37 detects changes in the amount of toner attached per unit area of the photoconductor 2, that is, image density of the test latent image pattern, over time. Based on the changes thus detected, the controller 37 identifies uneven image density in the main scanning direction, and adjusts the image forming conditions such as the charging bias of the charging rollers 3 and the exposure power or laser power of the optical writing unit 4 to reduce the uneven image density in the main scanning direction.

Figure 5:
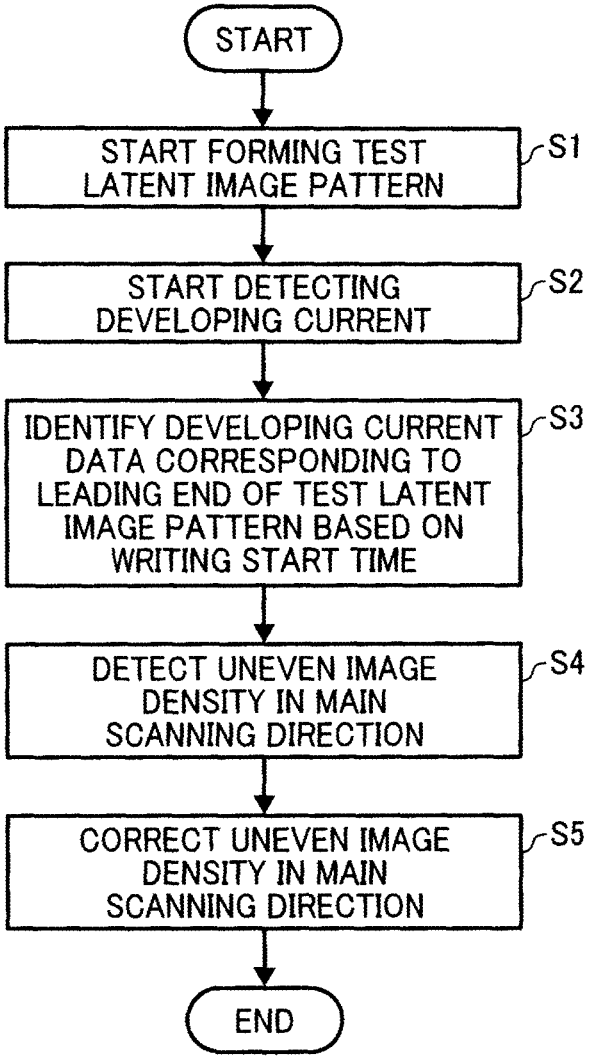
FIG. 5 is a flowchart of a process of correcting uneven image density in a main scanning direction executed by the image forming apparatus.

Referring now to FIG. 5, a detailed description is given of the process of correcting uneven image density in the main scanning direction. FIG. 5 is a flowchart of the process of correcting uneven image density in the main scanning direction.

In step S1, the optical writing unit 4 forms test latent image patterns on the photoconductors 2 sequentially. In step S2, the power supply 33 for development applies developing voltage to the developing rollers 5*a*, and the current detecting circuit 31 detects developing currents. The controller 37 stores the developing currents sequentially in the volatile memory as developing current data. The test latent image patterns formed by the optical writing unit 4 are supplied with toner moving from the developing rollers 5*a* while passing through the developing area as the photoconductors 2 rotate. The toner adheres to the test latent image patterns, rendering the test latent image patterns visible.

In step S3, based on a writing start time stored in the nonvolatile memory of the controller 37, that is, a time when formation of the test latent image pattern is started, the controller 37 identifies developing current data corresponding to a leading end of each of the test latent image patterns from the developing current data stored in the volatile memory. In other words, the controller 37 identifies a developing current value corresponding to a position of each of the test latent image patterns in a sub-scanning direction, that is, a developing current value corresponding to each of test latent image parts that constitute each of the test latent image patterns described later.

Figure 6:
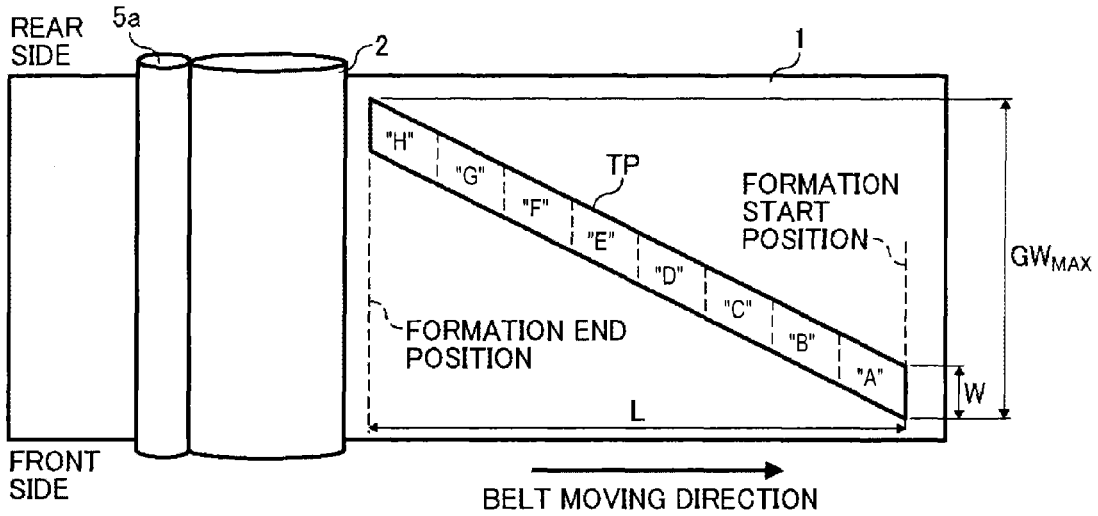
FIG. 6 is a plan view of a test toner pattern constituted of a plurality of continuous test toner parts.

Referring now to FIG. 6, a description is given of a test toner pattern TP into which a test latent image pattern is developed. FIG. 6 is a plan view of the test toner pattern TP constituted of a plurality of continuous test toner parts "A" through "H".

The top of FIG. 6 corresponds to a rear side of the image forming apparatus 100 while the bottom of FIG. 6 corresponds to a front side of the image forming apparatus 100. FIG. 6 illustrates the test toner pattern TP formed on the intermediate transfer belt 1. Alternatively, in some embodiments, the test toner pattern TP is formed on another transfer body.

In the present embodiment, the test latent image pattern is constituted of a plurality of continuous test latent image parts formed continuously in the sub-scanning direction and partly offset from one another in the main scanning direction. Specifically, in the sub-scanning direction, which is the direction in which the photoconductor 2 rotates, the test latent image pattern is formed such that the positions of the test latent image parts in the main scanning direction are displaced from one side (front side) to the other side (rear side) in the main scanning direction. More specifically, the optical writing unit 4 forms the plurality of test latent image parts having a length W in the main scanning direction (hereinafter referred to as a width W) continuously while changing its exposure position in the main scanning direction over time. Thus, a test latent image pattern is formed and developed into the test toner pattern TP constituted of continuous test toner parts as illustrated in FIG. 6. Although FIG. 6 illustrates 8 continuous test toner parts "A" through "H" into which 8 continuous test latent image parts are developed, the number of the test toner parts or test latent image parts is not limited thereto.

As illustrated in FIG. 6, in the present embodiment, the test latent image pattern has a constant width W in the main scanning direction at any position thereof in the sub-scanning direction. Additionally, the test latent image pattern is formed across a range $GW_{MAX}$ in the main scanning direction. $GW_{MAX}$ is a maximum image width for the image forming apparatus 100. Alternatively, in some embodiments, the test latent image pattern is formed within or over the range of the maximum image width $GW_{MAX}$.

In the present embodiment, the width W is about 30 mm. Alternatively, in some embodiments, the width W is any length not smaller than about 10 mm to detect a sufficient developing current. If the width W is smaller than about 10 mm, the developing current value detected is too small to keep an appropriate signal-noise ratio and may cause detection errors over an acceptable range.

On the other hand, the test latent image pattern is formed across a range L in the sub-scanning direction (hereinafter referred to as a length L), which is about 250 mm in the present embodiment. Alternatively, in some embodiments, the length L is any length that allows detection of a developing current according to a process speed (a rotational speed of the photoconductor 2) and a length of the test latent image pattern in the main scanning direction.

In the present embodiment, the image forming conditions such as developing bias, charging bias, and exposure power are held constant or fixed to detect a developing current for the test latent image pattern. Accordingly, the test latent image pattern has a uniform image density in the sub-scanning direction. In other words, the test latent image parts have a uniform amount of toner attached per unit area. The developing current during the developing process of the test latent image pattern is theoretically constant across an entire area of the test latent image pattern in the sub-scanning direction. Detection of changes in the developing current for the test latent image pattern over time means that the image density (i.e., amount of toner attached per unit area) changes in the main scanning direction. Accordingly, the uneven image density in the main scanning direction is detected based on the changes in the detected developing current for the test latent image pattern over time.

In the present embodiment, the resolution of detecting uneven image density depends on a sampling cycle in which the controller 37 acquires a developing current value for the test latent image pattern. The present embodiment facilitates acquisition of a relatively high resolution of detecting uneven image density in the main scanning direction by setting a sufficiently short sampling cycle.

Uneven image density in the sub-scanning direction may cause changes in the detected developing current for the test latent image pattern over time. However, in the present embodiment, the uneven image density in the sub-scanning direction is suppressed by correcting image forming conditions based on readings provided by the surface potential sensors 19 and the image density sensor 30. Accordingly, the uneven image density in the main scanning direction and the changes in the detected developing current for the test latent image pattern over time are correlated.

A larger amount of toner attached to the test latent image pattern per unit area corresponds to an increase in developing current. Accordingly, in the present embodiment, the image density of the test toner pattern TP is 100%, which is the maximum image density. However, the test toner pattern TP having an image density of at least 30% (of the maximum image density) suppresses the detection errors within the acceptable range.

As described above, in the present embodiment, the test latent image parts having the width W are continuously displaced from the front side to the rear side in the main scanning direction. Alternatively, the test latent image parts having the width W may be continuously displaced from the rear side to the front side in the main scanning direction. In the present embodiment, the test latent image pattern is constituted of the plurality of continuous test latent image parts formed continuously in the sub-scanning direction and partly offset from one another in the main scanning direction. Alternatively, the test latent image pattern may be constituted of a plurality of test latent image parts formed discontinuously in the sub-scanning direction and partly offset from one another in the main scanning direction.

Figure 7:
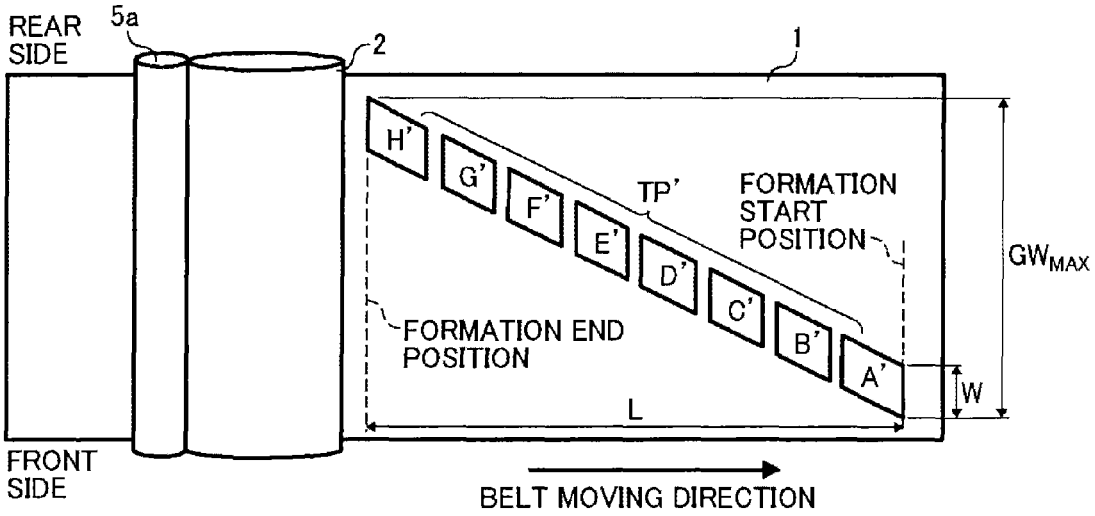
FIG. 7 is a plan view of a test toner pattern constituted of a plurality of discontinuous test toner parts.

FIG. 7 illustrates a test toner pattern TP' into which the test latent image pattern constituted of a plurality of discontinuous test latent image parts is developed. Although FIG. 7 illustrates 8 discontinuous test toner parts A' through H' into which 8 discontinuous test latent image parts are developed, the number of the test toner parts or test latent image parts is not limited thereto.

Figure 8:
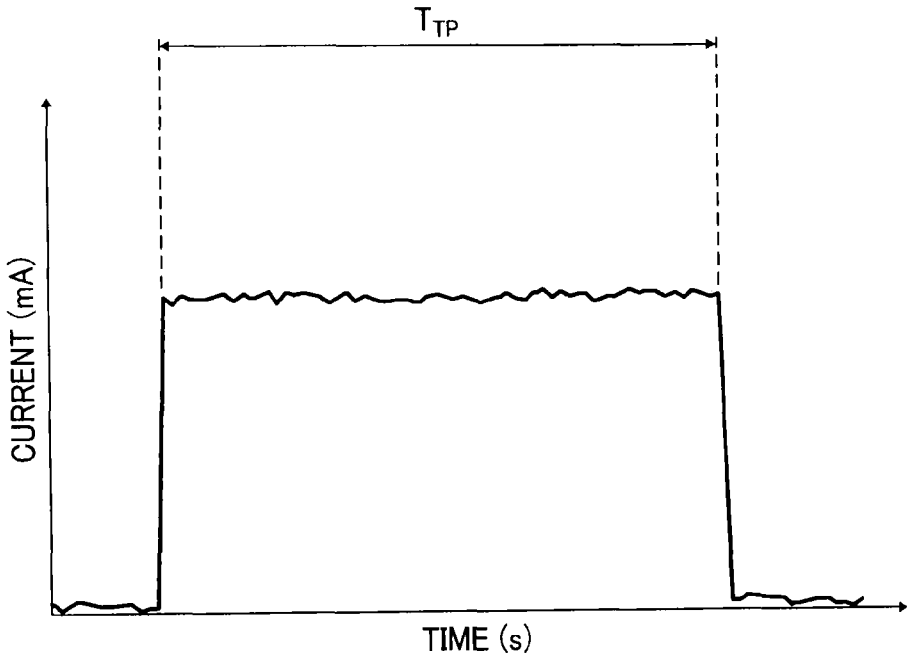
FIG. 8 is a graph illustrating a relation between time and current when image density is even.

FIG. 8 is a graph illustrating a relation between time and current that is detected for the test latent image pattern when image density is even in the main scanning direction.

As illustrated in FIG. 8, the developing current detected rises when a developing time $T_{TP}$ of the test latent image pattern starts, and drops when the developing time $T_{TP}$ of the test latent image pattern ends. In the present embodiment, as described above, the developing current value corresponding to each test latent image part of the test latent image pattern is identified based on the time when formation of the test latent image pattern is started. Alternatively, in some embodiments, the developing current value is identified based on the time when the developing current rises and the time when the developing current drops.

Figure 9:
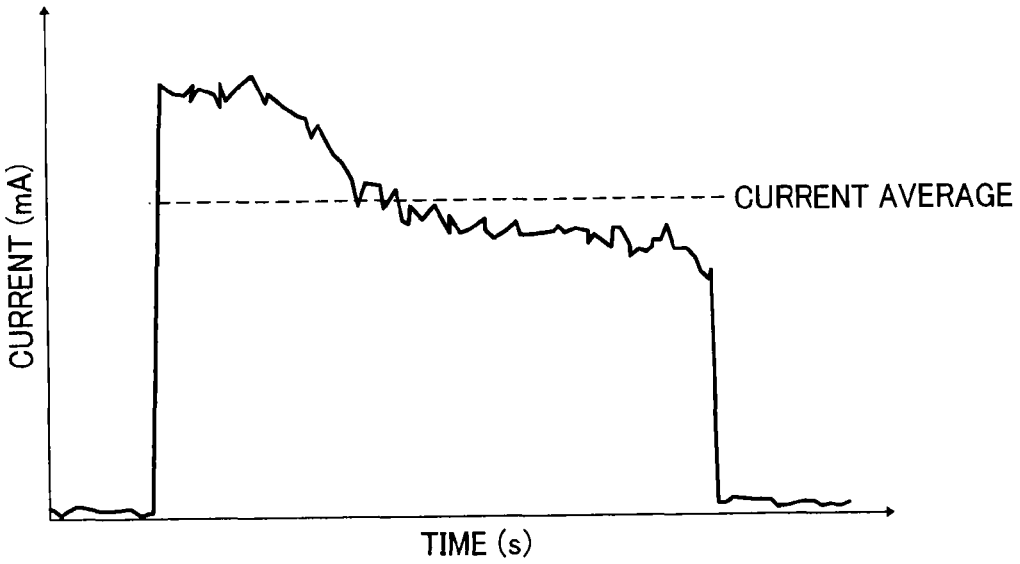
FIG. 9 is a graph illustrating a relation between time and current when image density is uneven.

FIG. 9 is a graph illustrating a relation between time and current that is detected for the test latent image pattern when image density is uneven in the main scanning direction.

FIG. 8 shows a stable developing current during development of the test latent image pattern, without dramatically changing over time, because image density is even in the main scanning direction. By contrast, FIG. 9 shows a gradually decreasing developing current during development of the test latent image pattern over time. A larger developing current increases the amount of toner attached during development. In the present embodiment, the test latent image parts of the test latent image pattern have the same width W in the main scanning direction. Therefore, FIG. 9 shows changes in the amount of toner attached to each test latent image part per unit area.

More specifically, the developing current value corresponding to a leading side of the test latent image pattern is higher than a developing current average, which is indicated by a broken line in FIG. 9. On the other hand, the developing current value corresponding to a trailing side of the test latent image pattern is lower than the developing current average. Based on the changes in the developing current over time illustrated in FIG. 9, uneven image density is detected in the main scanning direction. Specifically, the image density (i.e., amount of toner attached per unit area) on the front side is higher than a target image density while the image density on the rear side is lower than the target image density.

In step S4, as described above, the controller 37 detects uneven image density in the main scanning direction of the test latent image pattern according to the developing current inputted from the current detecting circuit 31. In step S5, the controller 37 executes a correction process to suppress the uneven image density in the main scanning direction. In the present embodiment, the controller 37 controls the exposure power of the optical writing unit 4 to suppress the detected uneven image density in the main scanning direction.

Specifically, the nonvolatile memory of the controller 37 preliminarily stores a data table correlating correction values of exposure power and image density deviations with respect to the target image density. The controller 37 identifies an image density deviation at each position in the main scanning direction with respect to the target image density from the detected uneven image density in the main scanning direction, and determines a correction value of exposure power at each position in the main scanning direction with reference to the data table. Then, the controller 37 corrects setting data of the exposure power of the optical writing unit 4 using the correction value of exposure power thus determined. For example, in response to the changes in the developing current as illustrated in FIG. 9, the controller 37 adjusts the exposure power to decrease the image density on the front side and to increase the image density on the rear side. As a result, in the subsequent image forming operation, an image is formed suppressing uneven image density in the main scanning direction. The exposure power is adjusted for each position in the main scanning direction by, e.g., shading correction.

In the present embodiment, the correction value of exposure power is calculated by converting a developing current value inputted to the controller 37 into data of image density deviation with respect to the target image density. Alternatively, in some embodiments, the correction value of exposure power is calculated by converting the developing current value inputted to the controller 37 into other data such as image density (i.e., amount of toner attached per unit area), or the correction value of exposure power is calculated directly from the developing current value.

Alternatively, the correction value of exposure power for each position in the main scanning direction is calculated by a suitable approximation of developing current data of the entire test latent image pattern and correlating it with each position in the main scanning direction.

In the present embodiment, detection of uneven image density in the main scanning direction is completed when development of the test latent image pattern is completed. Accordingly, the test toner pattern TP into which the test latent image pattern is developed is transferred from each of the photoconductors 2 onto the intermediate transfer belt 1 with or without being superimposed on one another, and then removed from the intermediate transfer belt 1 by a cleaner. Thus, the uneven image density in the main scanning direction is detected for each of the photoconductors 2, shortening the duration of detecting the uneven image density in the main scanning direction for all the photoconductors 2.

Figure 10:
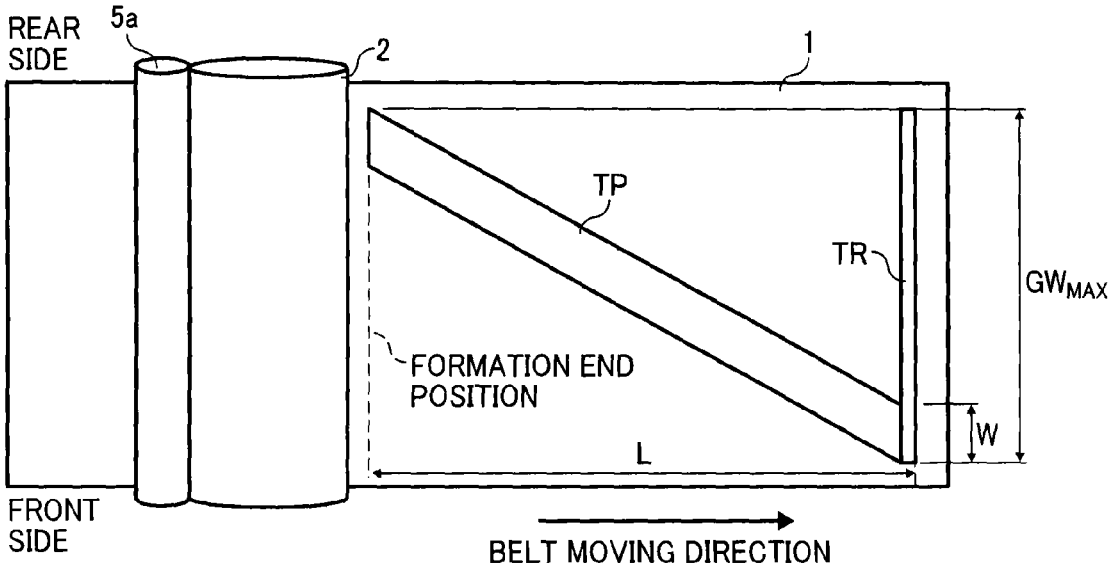
FIG. 10 is a plan view of a test toner pattern and a trigger pattern according to a variation of an embodiment of the present invention.
Figure 11:
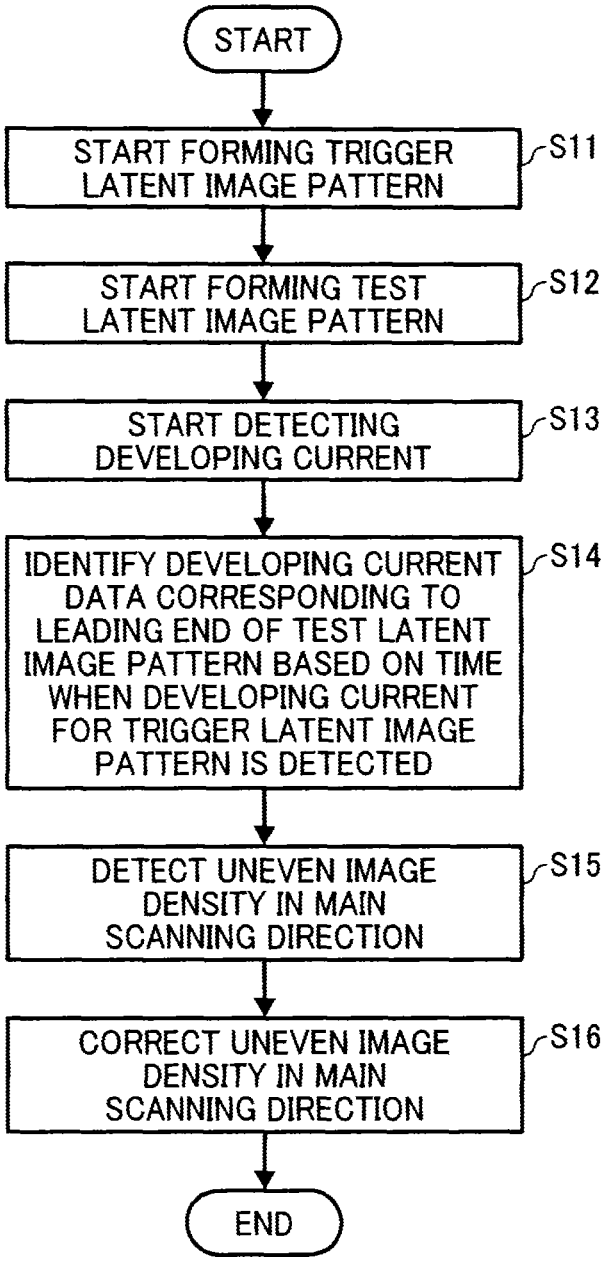
FIG. 11 is a flowchart of a process of correcting uneven image density in the main scanning direction according to the variation.

Referring to FIG. 10 through FIG. 11, a description is now given of a variation of the above-described process of correcting uneven image density in the main scanning direction.

As described above, in some embodiments, the developing current value corresponding to each test latent image parts of the test latent image pattern is identified based on the time when the developing current rises and the time when the developing current drops, instead of identifying the developing current value based on the time when formation of the test latent image pattern is started. However, a relatively small developing current during development of the test latent image pattern may prevent accurate detection of the time when the developing current rises or drops and further prevent accurate identification of the relation between the developing current value and each test latent image part of the test latent image pattern.

According to the present variation, a trigger latent image pattern is formed as a reference latent image pattern at a predetermined position relative to the test latent image pattern in the sub-scanning direction. A developing current value corresponding to each test latent image part of the test latent image pattern is identified based on the time when the current detecting circuit 31 detects a developing current during development of the trigger latent image pattern.

FIG. 10 is a plan view of a test toner pattern TP into which a test latent image pattern is developed and a trigger pattern TR into which a trigger latent image pattern is developed.

As illustrated in FIG. 10, the trigger pattern TR is continuous with a leading end (upstream end in the sub-scanning direction) of the test toner pattern TP on the intermediate transfer belt 1. The trigger pattern TR has the same length in the main scanning direction as the maximum image width $GW_{MAX}$ for the image forming apparatus 100. Alternatively, in some embodiments, the trigger pattern TR has a shorter or longer length than the maximum image width $GW_{MAX}$ provided that the trigger pattern TR has a longer length in the main scanning direction than the width W of each test latent image part (i.e., each part in the sub-scanning direction) of the test toner pattern TP in the main scanning direction.

The length of the trigger pattern TR in the sub-scanning direction may be shorter than a range (i.e., length) of the test toner pattern TP in the sub-scanning direction provided that a larger developing current is detected than the developing current detected for the test toner pattern TP. In the present embodiment, the image density of the trigger pattern TR is 100%, which is the maximum image density, to obtain a relatively large developing current for the trigger pattern TR. However, a trigger patter TR having an image density of at least 30% (of the maximum image density) obtains a sufficient amount of developing current.

In the present variation, the trigger pattern TR and the test toner pattern TP have the same image density of 100%. Alternatively, the trigger pattern TR and the test toner pattern TP may have different image densities. In some embodiments, the trigger latent image pattern is positioned on the trailing side of the test latent image pattern. The trigger latent image pattern and the test latent image pattern may be positioned discontinuously in the sub-scanning direction provided that the trigger latent image pattern is formed at the predetermined position relative to the test latent image pattern in the sub-scanning direction.

FIG. 11 is a flowchart of a process of correcting uneven image density in the main scanning direction according to the present variation.

The process according to the present variation starts with forming a trigger latent image pattern (S11) before forming a test latent image pattern (S12). Specifically, the optical writing unit 4 forms a trigger latent image pattern in step S11, and continuously, forms a test latent image pattern on the photoconductors 2 in step S12. In step S13, the power supply 33 for development applies developing voltage to the developing rollers 5*a*, and the controller 37 stores developing currents detected by the current detecting circuit 31 sequentially in the volatile memory as developing current data.

Figure 12:
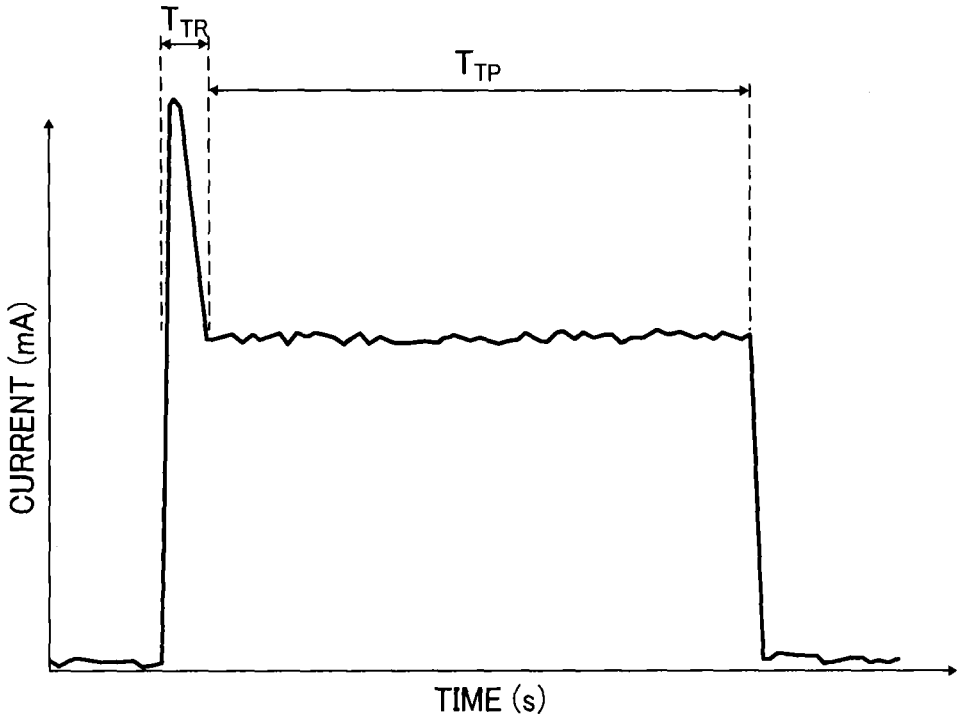
FIG. 12 is a graph illustrating a relation between time and current according to the variation.

The controller 37 detects the time when the developing current rises, based on the developing currents sequentially inputted from the current detecting circuit 31. In the present variation, the developing current for the trigger latent image pattern is detected before the developing current for the test latent image pattern is detected. The developing current for the trigger latent image pattern is larger than the developing current for the test latent image pattern as illustrated in FIG. 12. Accordingly, the controller 37 clearly detects the time when the developing current for the trigger latent image pattern is detected even if the developing current for the test latent image pattern is relatively small. It is to be noted that, FIG. 12 illustrates a developing time $T_{TR}$ of the trigger latent image pattern and a developing time $T_{TP}$ of the test latent image pattern. The time from when the developing current for the trigger latent image pattern is detected until the developing current for the test latent image pattern is detected are ascertained in advance. Accordingly, in step S14, the controller 37 identifies developing current data corresponding to the leading end of the test latent image pattern from the developing current data stored in the volatile memory, based on the time when the developing current for the trigger latent image pattern is detected, even if the developing current for the test latent image pattern is relatively small. In other words, the controller 37 identifies a developing current value corresponding to a position of the test latent image pattern in the sub-scanning direction, that is, a developing current value corresponding to each of the test latent image parts that constitute the test latent image pattern.

In step S15, the controller 37 detects uneven image density in the main scanning direction based on changes in the developing current for the test latent image pattern detected over time. In step S16, the controller 37 executes a correction process to suppress the uneven image density in the main scanning direction.

Although specific embodiments are described, the embodiments of the present invention are not limited to those specifically described herein. For example, the image forming apparatus 100 may be a copier, a printer, a facsimile machine, a plotter, or a multifunction peripheral having those capabilities, such as a color digital multifunction peripheral for forming a full-color image, or a monochrome machine for forming a monochrome image. The image forming apparatus 100 is capable of forming an image on recording sheets such as plain paper, overhead projector (OHP) sheets, thick paper including cards and postcards, and envelopes. The developer used in the image forming apparatus 100 is not limited to two-component developer. Alternatively, one-component developer may be used.

In addition, advantages of embodiments of the present invention are not limited to the above-described advantages.

Several aspects of the image forming apparatus are exemplified as follows.

According to a first aspect, an image forming apparatus (e.g., image forming apparatus 100) includes a rotatable latent image bearer (e.g., photoconductor 2), a toner image forming unit, and a transfer device (e.g., transfer device 16). The toner image forming unit includes a charger (e.g., charging roller 3) to charge a surface of the latent image bearer, a latent image forming device (e.g., optical writing unit 4) to form a latent image on the surface of the latent image bearer according to image data, and a developing device (e.g., developing device 5) that includes a developer bearer (e.g., developing roller 5*a*) to apply developing bias between the latent image bearer and the developer bearer to move toner from the developer bearer to the latent image to form a toner image on the surface of the latent image bearer. The transfer device transfers the toner image onto a recording medium. The toner image forming unit is configured to form a test latent image pattern on the surface of the latent image bearer, and to develop the test latent image pattern into a test toner pattern (e.g., test toner pattern TP). The test latent image pattern includes a plurality of test latent image parts partly offset from one another in a main scanning direction that is perpendicular to a direction in which the latent image bearer rotates. The image forming apparatus also includes a developing current detector (e.g., current detecting circuit 31) to detect a developing current between the developer bearer and the latent image bearer during development of the test latent image pattern, and a processor (e.g., controller 37) to detect uneven image density in the main scanning direction using the test latent image pattern, based on the developing current detected by the developing current detector, to adjust the uneven image density in the main scanning direction, such as correction of the uneven image density in the main scanning direction.

Typically, such test latent image patterns each including a plurality of test latent image parts having different areas in the main scanning direction are developed at different times. The image density is detected for each area from the developing current for each test latent image part. In order to obtain a high resolution of detecting uneven image density in the main scanning direction, the number of areas to obtain the image density is increased by shortening the length of each test latent image part in the main scanning direction. However, the developing current is decreased during development of each test latent image part and worsen the signal-noise ratio of the developing current detected. As a result, the image density may not be identified for each area with acceptable accuracy.

By contrast, according to the present aspect, the plurality of test latent image parts constituting the test latent image pattern is partly offset from one another in the main scanning direction. When the number of areas to obtain the image density is increased in order to obtain a high resolution for detecting uneven image density, each test latent image part corresponding to each of the areas to obtain the image density has a sufficient length in the main scanning direction to detect a sufficient amount of developing current having a reliable signal-noise ratio. It is to be noted that each test latent image part includes a latent image portion within its corresponding area to obtain the image density and a latent image portion out of the corresponding area. In other words, the developing current during development of each test latent image part includes a current component corresponding to image density within the corresponding area and a current component corresponding to image density out of the corresponding area, which may decrease the accuracy of identifying the image density for each area corresponding to each test latent image part from the developing current for each test latent image part. However, the developing current with a reliable signal-noise ratio is detected by limiting the length of each test latent image part in the main scanning direction while maintaining a correlation between the developing current detected for each test latent image part and the image density within the corresponding area. Thus, the present aspect provides both high resolution and high accuracy of detecting uneven image density in the main scanning direction.

According to a second aspect, the adjustment includes adjustment of a toner image forming condition for the toner image forming unit to suppress the uneven image density based on the uneven image density detected in the main scanning direction.

Accordingly, an image is formed suppressing uneven image density in the main scanning direction.

According to a third aspect, in the image forming apparatus according to the second aspect, the toner image forming condition includes a latent image forming condition such as exposure power, thereby facilitating adjustment of image density for each position in the main scanning direction.

According to a fourth aspect, the plurality of test latent image parts has an identical length in the main scanning direction.

Accordingly, the developing current detected for the test latent image pattern does not include different developing currents which may be generated by the difference in the length of the plurality of test latent image parts in the main scanning direction. In other words, the uneven image density is detected in the main scanning direction by detecting the developing current, obviating the need to take into account the difference in the length of the plurality of test latent image parts in the main scanning direction, and facilitating the process of detecting uneven image density in the main scanning direction.

According to a fifth aspect, the toner image forming condition is stable until development of the test latent image pattern is completed.

Accordingly, the developing current detected for the test latent image pattern does not include different developing currents which may be generated by the difference in the length of the plurality of test latent image parts in the main scanning direction. In other words, the uneven image density in the main scanning direction is detected by detecting the developing current, obviating the need to take into account the difference in the length of the plurality of test latent image parts in the main scanning direction, and facilitating the process of detecting uneven image density in the main scanning direction.

According to a sixth aspect, the test toner pattern has an image density not lower than 30%.

Accordingly, the developing current having a reliable signal-noise ratio is detected for the test latent image pattern, and therefore, the uneven image density in the main scanning direction is accurately detected.

According to a seventh aspect, the plurality of test latent image parts has a length not smaller than 10 mm in the main scanning direction.

Accordingly, the developing current having a reliable signal-noise ratio is detected for the test latent image pattern, and therefore, the uneven image density in the main scanning direction is accurately detected.

According to an eighth aspect, a position of the plurality of test latent image parts in the main scanning direction is displaced in the direction in which the latent image bearer rotates, from a first end of the test latent image pattern in the main scanning direction to a second end of the test latent image pattern in the main scanning direction.

Relative positions between a detected developing current value and a position in the main scanning direction facilitate detection of uneven image density in the main scanning direction.

According to a ninth aspect, the toner image forming unit forms a reference latent image pattern having a larger length in the main scanning direction than the plurality of test latent image parts at a predetermined position relative to the test latent image pattern in the direction in which the latent image bearer rotates. The developing current detector detects developing currents during development of the test latent image pattern and the reference latent image pattern. The processor identifies a developing current for the test latent image pattern from the developing currents detected by the developing current detector, based on a time when the developing current detector detects the developing current for the reference latent image pattern, to detect uneven image density in the main scanning direction.

Accordingly, as described with reference to the variation above, even if a relatively small developing current is detected for the test latent image pattern, identification of the time when the developing current detector detects the developing current for the reference latent image pattern facilitates accurate acquisition of a relation between developing current and each of the test latent image parts constituting the test latent image pattern, thereby enhancing accurate detection of uneven image density in the main scanning direction.

According to a tenth aspect, in the image forming apparatus according to the ninth aspect, the toner image forming unit develops the reference latent image pattern into a reference toner pattern having an image density not lower than 30%, thereby facilitating acquisition of the relation between developing current and each test latent image part of the test latent image pattern based on the time when the developing current detector detects the developing current for the reference latent image pattern.

According to an eleventh aspect, the plurality of test latent image parts is formed continuously in a sub-scanning direction.

According to a twelfth aspect, the plurality of test latent image parts is formed discontinuously in a sub-scanning direction.

Numerous additional modifications and variations are possible in light of the above teachings. It is therefore to be understood that within the scope of the appended claims, the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of the present invention and appended claims.

Further, any of the above-described devices or units can be implemented as a hardware apparatus, such as a special-purpose circuit or device, or as a hardware/software combination, such as a processor executing a software program.

What is claimed is:

1. An image forming apparatus comprising:

a rotatable latent image bearer;

a toner image forming mechanism, the toner image forming mechanism comprising:

a charger to charge a surface of the latent image bearer;

a latent image forming device to form a latent image on the surface of the latent image bearer according to image data; and a developing device comprising a developer bearer, to apply developing bias between the latent image bearer and the developer bearer to move toner from the developer bearer to the latent image to form a toner image on the surface of the latent image bearer, the toner image forming mechanism configured to form a test latent image pattern on the surface of the latent image bearer, and to develop the test latent image pattern into a test toner pattern, the test latent image pattern including a plurality of test latent image parts partly offset from one another in a main scanning direction that is perpendicular to a direction in which the latent image bearer rotates;

a transfer device to transfer the toner image onto a recording medium;

a developing current detector to detect a developing current between the developer bearer and the latent image bearer during development of the test latent image pattern; and a processor to detect uneven image density in the main scanning direction using the test latent image pattern, based on the developing current detected by the developing current detector, to adjust the uneven image density in the main scanning direction, wherein a shape of each of the plurality of test latent image parts is offset in the main scanning direction perpendicular to the direction in which the latent image bearer rotates, such that a leading edge and a trailing edge of each test latent image part in the direction in which the latent image bearer rotates are displaced with respect to each other in the main scanning direction.

2. The image forming apparatus according to claim 1, wherein the adjustment comprises adjustment of a toner image forming condition for the toner image forming mechanism to suppress the uneven image density based on the uneven image density detected in the main scanning direction.

3. The image forming apparatus according to claim 2, wherein the toner image forming condition comprises a latent image forming condition.

4. The image forming apparatus according to claim 1, wherein the plurality of test latent image parts has an identical length in the main scanning direction.

5. The image forming apparatus according to claim 1, wherein a toner image forming condition for the toner image forming mechanism is stable until development of the test latent image pattern is completed.

6. The image forming apparatus according to claim 1, wherein the test toner pattern has an image density not lower than 30%.

7. The image forming apparatus according to claim 1, wherein the plurality of test latent image parts has a length not smaller than 10 mm in the main scanning direction.

8. The image forming apparatus according to claim 1, wherein a position of the plurality of test latent image parts in the main scanning direction is displaced in the direction in which the latent image bearer rotates, from a first end of the test latent image pattern in the main scanning direction to a second end of the test latent image pattern in the main scanning direction.

9. The image forming apparatus according to claim 1, wherein the toner image forming mechanism forms a reference latent image pattern having a larger length in the main scanning direction than a width of each of the test latent image parts in the main scanning direction, wherein the developing current detector detects developing currents during development of the test latent image pattern and the reference latent image pattern, and wherein the processor identifies a developing current for the test latent image pattern from the developing currents detected by the developing current detector, based on a time when the developing current detector detects the developing current for the reference latent image pattern, to detect uneven image density in the main scanning direction.

10. The image forming apparatus according to claim 9, wherein the toner image forming mechanism develops the reference latent image pattern into a reference toner pattern having an image density not lower than 30%.

11. The image forming apparatus according to claim 1, wherein the plurality of test latent image parts is formed continuously in a sub-scanning direction.

12. The image forming apparatus according to claim 11, wherein each test latent image part shares at least one of a leading edge and a trailing edge in the sub-scanning direction with one of a leading edge and a trailing edge of an adjacent test latent image part.

13. The image forming apparatus according to claim 1, wherein the plurality of test latent image parts is formed discontinuously in a sub-scanning direction.

* * * * *